US008191489B1

(12) United States Patent
Smith

(10) Patent No.: US 8,191,489 B1
(45) Date of Patent: Jun. 5, 2012

(54) COLLAPSIBLE TRANSPORT, STORAGE AND DISPLAY TABLE

(76) Inventor: Gene A. Smith, Bokeelia, FL (US)

( * ) Notice: Subject to any disclaimer, the term of this patent is extended or adjusted under 35 U.S.C. 154(b) by 0 days.

(21) Appl. No.: 13/068,278

(22) Filed: May 9, 2011

Related U.S. Application Data

(60) Provisional application No. 61/343,982, filed on May 6, 2010.

(51) Int. Cl.
*A47B 91/00* (2006.01)

(52) U.S. Cl. ..... 108/186; 108/91; 108/157.18; 108/158.12; 108/193

(58) Field of Classification Search ..... 108/91, 108/180, 186, 193, 146, 147.16, 147.18, 108/156, 157.16, 157.18, 158.12, 159.11; 47/82–83; 211/186–192
See application file for complete search history.

(56) References Cited

U.S. PATENT DOCUMENTS

| | | | | | |
|---|---|---|---|---|---|
| 1,891,393 | A | * | 12/1932 | Oppenlander | 108/189 |
| 3,771,466 | A | * | 11/1973 | Ferdinand et al. | 108/109 |
| 4,025,216 | A | * | 5/1977 | Hives | 108/158.12 |
| 4,145,977 | A | * | 3/1979 | Yellin | 108/190 |
| 4,467,927 | A | * | 8/1984 | Nathan | 108/91 |
| 4,856,434 | A | * | 8/1989 | Smith | 108/180 |
| 4,961,506 | A | * | 10/1990 | Lang | 211/188 |
| 5,579,702 | A | * | 12/1996 | Aho | 108/91 |
| 5,641,080 | A | * | 6/1997 | Humphrey et al. | 211/188 |

* cited by examiner

*Primary Examiner* — Hanh V Tran
(74) *Attorney, Agent, or Firm* — William E. Noonan

(57) ABSTRACT

A collapsible transport, storage and display table includes a plurality of rectangular plastic shelves supported at their mid-sections by respective plastic support posts. Each shelf includes an interior framework and a peripheral lip formed unitarily with the framework. A gap is formed in the lip at the midsection of each side edge for receiving a respective support post such that the support post securely, yet releasably interengages a respective shelf. The peripheral lip forms a receptacle in the shelf for accommodating four support posts in a collapsed condition.

18 Claims, 9 Drawing Sheets

COLLAPSIBLE TRANSPORT, STORAGE AND DISPLAY TABLE

RELATED APPLICATION

This application claims the benefit of U.S. Provisional Patent Application Ser. No. 61/343,982 filed May 6, 2010.

FIELD OF THE INVENTION

This invention relates to a collapsible transport, storage and display table that is especially suited for accommodating small, crushable or sensitive items such as flowers, plants and vegetables.

BACKGROUND OF THE INVENTION

Containers carrying flowers, plants, vegetables and the like have traditionally been shipped, stored and displayed for retail sale by means of collapsible steel racks. Large retailers such as warehouse establishments, home improvement stores and garden centers commonly utilize large numbers of these racks. After the plants or other products are sold, the racks are usually collapsed and returned to the supplier for re-use.

Traditional steel shipping and display racks tend to be quite expensive. Moreover, even when these products are collapsed for return, they still tend to take up an undesirably large amount of transport and storage space. This can increase the retailers and/or supplier's costs considerably. In addition, standard display racks utilize posts at the corners of the shelves. This does not provide optimal product support, which can cause the shelves to sag or bow under the weight of the accommodated product. Steel racks are also likely to rust and deteriorate prematurely.

To address the problems exhibited by conventional racks, I have previously provided a table for shipping, storing and displaying products such as pots and trays of flowers and plants. See U.S. Pat. No. 4,856,434 (hereinafter U.S. Pat. No. '434). That table utilizes a plurality of molded plastic posts that support a series of plywood shelves for accommodating product thereon. Each post is positioned at the center or midsection of each shelf edge. This table is much less expensive and more compactly collapsible than conventional metal racks. Moreover, because the posts are arranged at the midsections of the plywood shelves, stronger support is provided for the accommodated plants or other products.

Although my previous table represents a significant improvement over conventional metal racks, it still encounters some problems because it utilizes plywood shelves. A high level of precision is required to construct shelves that fit the molded receptacles of the plastic posts perfectly. If the plywood is not cut carefully and precisely, it will likely not properly fit the post and must be discarded and re-cut. This can result in considerable waste. It can also require additional time, labor and expense to correct and complete assembly of the table. Even when properly cut and fitted, plywood shelves do not provide an optimally strong support. Over time, such shelves tend to weather, age, warp and/or deteriorate.

SUMMARY OF THE INVENTION

It is therefore an object of the present invention to provide an improved and less expensive collapsible table for transporting, storing and displaying flowers, vegetables, plants and similar small, sensitive and/or crushable items.

It is a further object of this invention to provide a shipping and display table that may be quickly and conveniently collapsed into an extremely compact condition so that it is easier and less expensive to return and reuse.

It is a further object of this invention to provide an extremely durable and strong display, storage and transport table featuring plastic shelves that accommodate a wide variety of items without sagging or premature deterioration.

It is a further object of this invention to provide a molded plastic transport, storage and display table that is especially effective for supporting plants, flowers, vegetables and the like in their individual pots and without requiring storage trays or flats.

It is a further object of this invention to provide a transport, storage and display table that may be used efficiently and cost effectively by a wide variety of commercial establishments and particularly those that display and sell plants, flowers and the like.

It is a further object of this invention to provide a transport, storage and display table that eliminates the use of plywood shelves, as well as the labor, time, expense and material waste typically associated with constructing and installing such shelves.

It is a further object of this invention to provide a transport, storage and display table using rugged molded plastic shelves, which fit much more precisely and reliably with the support posts of the table than conventional plywood shelves.

It is a further object of this invention to provide transport, storage and display table that allows supportive posts to be compactly collapsed and accommodated within an upper receptacle of one of the shelves so that the collapsed table requires less storage and transport space than has previously been required and is therefore much easier and less expensive to return for reuse.

It is a further object of this invention to provide a transport, storage and display table that holds small, sensitive and crushable items such as flowers and plants in a more supported and protected manner so that such items avoid damage during shipment and display.

This invention results from a realization that an improved, stronger and more reliably fitted shelf for a transport, storage and display table may be provided by utilizing a molded plastic shelf that is collapsibly interengaged with four molded plastic center support posts. This invention results from the further realization that improved compact collapsibility is achieved by providing the shelf with a peripheral lip that effectively defines a receptacle in the top surface of the shelf for accommodating the four molded support posts. In addition, by providing each shelf with a grid-like internal framework, openings are provided in the shelf for conveniently accommodating individual plant containers and flowerpots. This allows the retailer and shipper to more efficiently and cost effectively accommodate product on the shelves.

This invention features a collapsible table for transporting, shipping and displaying products such as plants and flowers. More particularly, the invention relates to a molded plastic shelf or pallet used in such tables. The table includes a unitary shelf that features a molded plastic construction. The shelf includes an interior grid or framework having a series of openings formed vertically therethrough. The shelf also includes an exterior lip extending peripherally about the framework and projecting vertically above an upper surface of the framework. A gap or recess is provided in the lip at a midsection of each side edge of the rectangular shelf. A respective plastic support post retainably interengages the framework through each gap. Four support posts thereby interengage the framework of the shelf. Each support post includes a supportive lower portion that extends below the interengaged framework to engage one of an underlying surface or the upper end of a lower support post. The support post extends vertically upwardly and has a plurality of horizontal channels formed therein for interengaging and retaining respective analogously constructed shelves.

In particular, each shelf may feature a unitary molded plastic construction with an interior framework and an integral exterior lip extending peripherally about the framework. Each shelf includes a generally rectangular configuration with a respective gap formed in the lip at approximately the midsection of each of the four edges of the shelf. Each gap receives a respective one of the horizontal channels of a corresponding support post such that the received horizontal channel supportively interengages a recessed portion of the interior framework of the shelf. Each shelf is thereby securely interengaged with and supported by each of the four support posts.

In a preferred embodiment, each molded plastic shelf features a framework having a rectangular grid pattern with multiple rows and columns of openings formed vertically therethrough. First connector components may be carried by each shelf respectively within each gap of the shelf and complementary second connector components may be carried respectively by the support posts for releasably and retainably interengaging the first connector components. The first connector components may include spring clips attached to and extending from respective sides of the framework and the second connector components may include locking slots for lockably and releasably receiving the respective spring clips to releasably secure the shelves to the support posts. Multiple sets of complementary second connector components may be carried by the support posts for retaining respective shelves at various spaced apart heights. The locking slots in each support post may be positioned centrally and arranged in a vertically spaced apart pattern on the support post. Each locking slot may be formed through a respective horizontal channel and, more particularly, through a respective retention block positioned within a respective horizontal channel of the support post. The framework may include a notch within each gap in the peripheral lip. A respective spring clip may be attached to the framework and extend outwardly through each notch. The notch may receive a respective retention block such that the spring clip extending through that notch is received by the locking slot formed in that retention block. This securely fastens the support post to one side of the shelf. The framework may include tab segments having a reduced thickness adjacent each gap for engaging the horizontal channel of the support post on respective sides of the retention block.

Each side of each shelf may include a pair of legs that depend from the shelf within the gap formed in that side of the shelf. The legs may be inclined or taper outwardly relative to the shelf for interengaging an inner surface of a respective support post, engaged with the shelf. When the support posts are disengaged from the shelf, the legs are capable of supporting the shelf, and products accommodated thereon, above an underlying surface such as the ground, floor, etc.

Each support post may include a supportive lower section for engaging either a generally horizontal underlying surface or a lower underlying support post. The opposite, upper end of each support post carries a mounting flange for interengaging an upper support post mounted or stacked thereon. As a result, multiple support posts may be vertically assembled in a generally stacked manner to form a table with additional shelves. The legs of the lowermost shelf attached to each support post typically nestably interengage the supportive lower section of that support posts. An improved rigid construction is thereby provided.

The table is conveniently collapsed when required by releasably unlocking and disengaging the support posts from the respective shelves to which the posts are connected. Four support posts may be disposed on the top surface of a selected shelf and securely retained therein by the peripheral lip extending about that shelf.

Vertical holes may be formed in each of the shelves. A plurality of such holes may be formed proximate the lip and a single hole may be formed centrally through each shelf. These holes are aligned when the table is assembled and the aligned holes are capable of receiving respective rods that facilitate movement of the assembled table upon casters or the like.

DETAILED DESCRIPTION OF A PREFERRED EMBODIMENT

Other objects, features and advantages will occur from the following description of a preferred embodiment and the accompanying drawings, in which.

Figure 1:
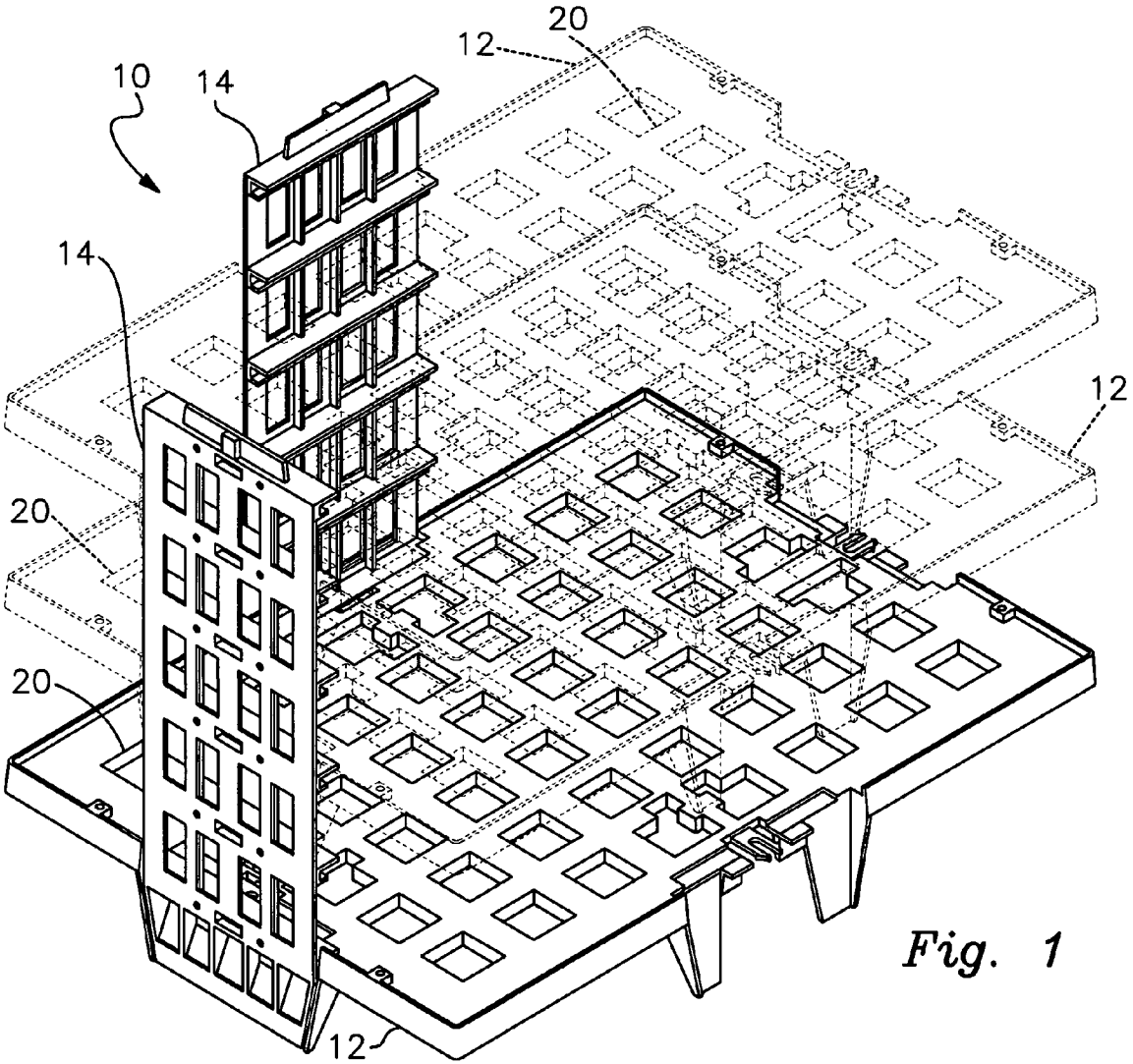
FIG. 1 is a perspective view of a preferred transport, storage and display table according to this invention with a pair of support posts omitted and a pair of upper shelves shown in phantom for clarity.
Figure 1A:
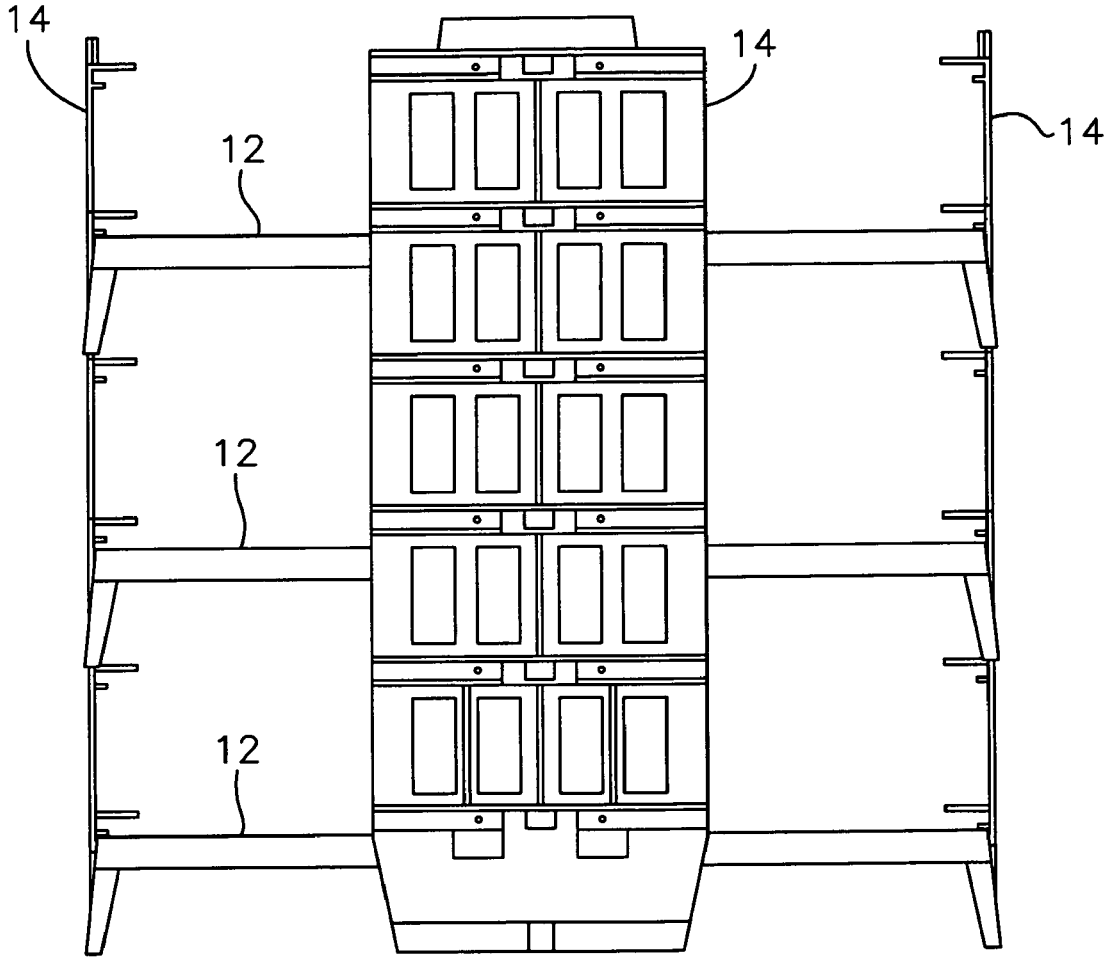
FIG. 1A is an elevational side view of the table.

There is shown in FIGS. 1 and 1A an assembled transport, storage and display table 10 in accordance with this invention. Table 10 is designed for accommodating small horticultural products such as flowers and plants during transport, storage and retail display. The particular type of product accommodated by table 10 is not a limitation of this invention and, indeed, alternative types of products may be accommodated.

Figure 2:
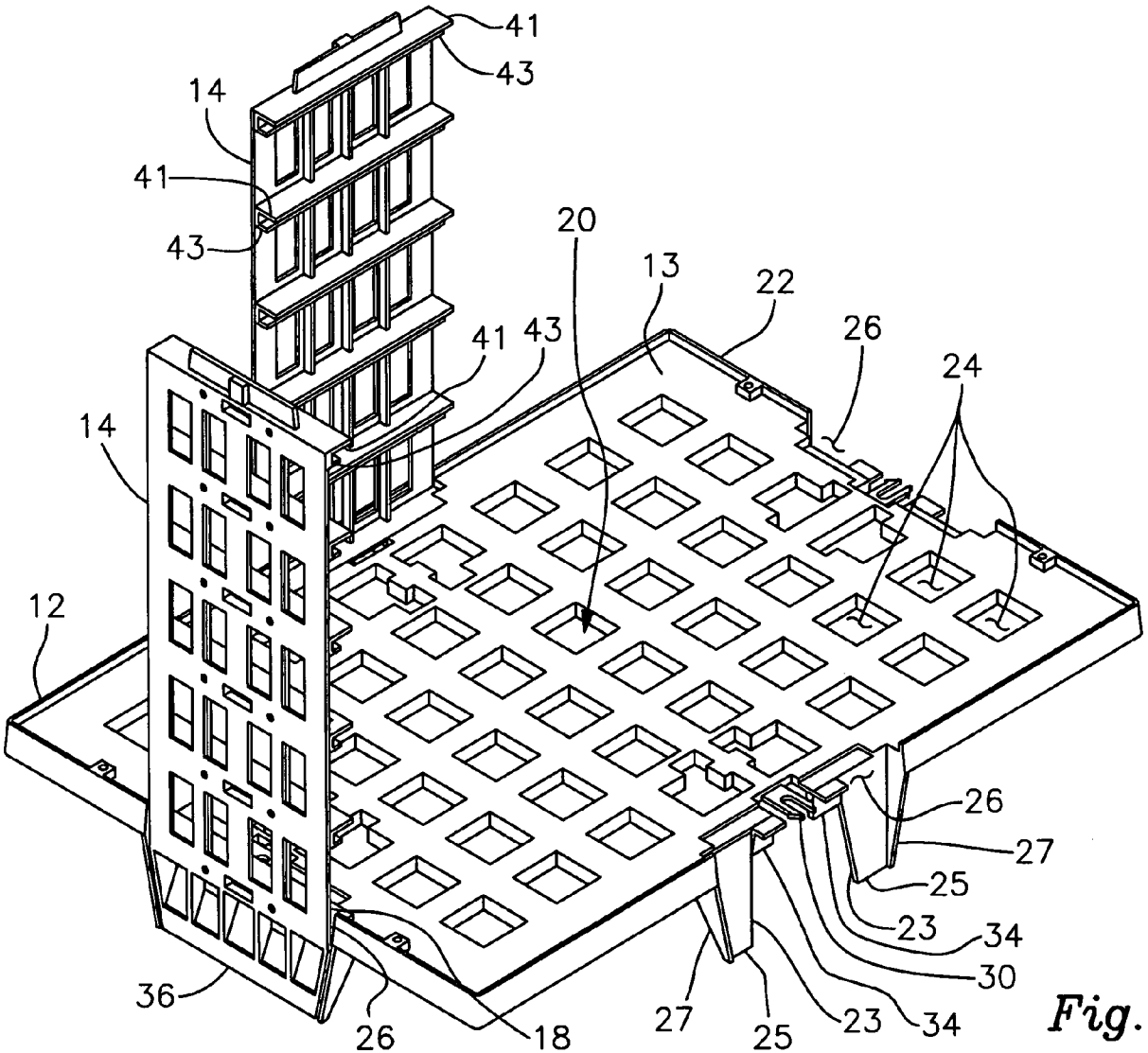
FIG. 2 is a perspective view of a single shelf interengaged by a single pair of support posts.
Figure 3:
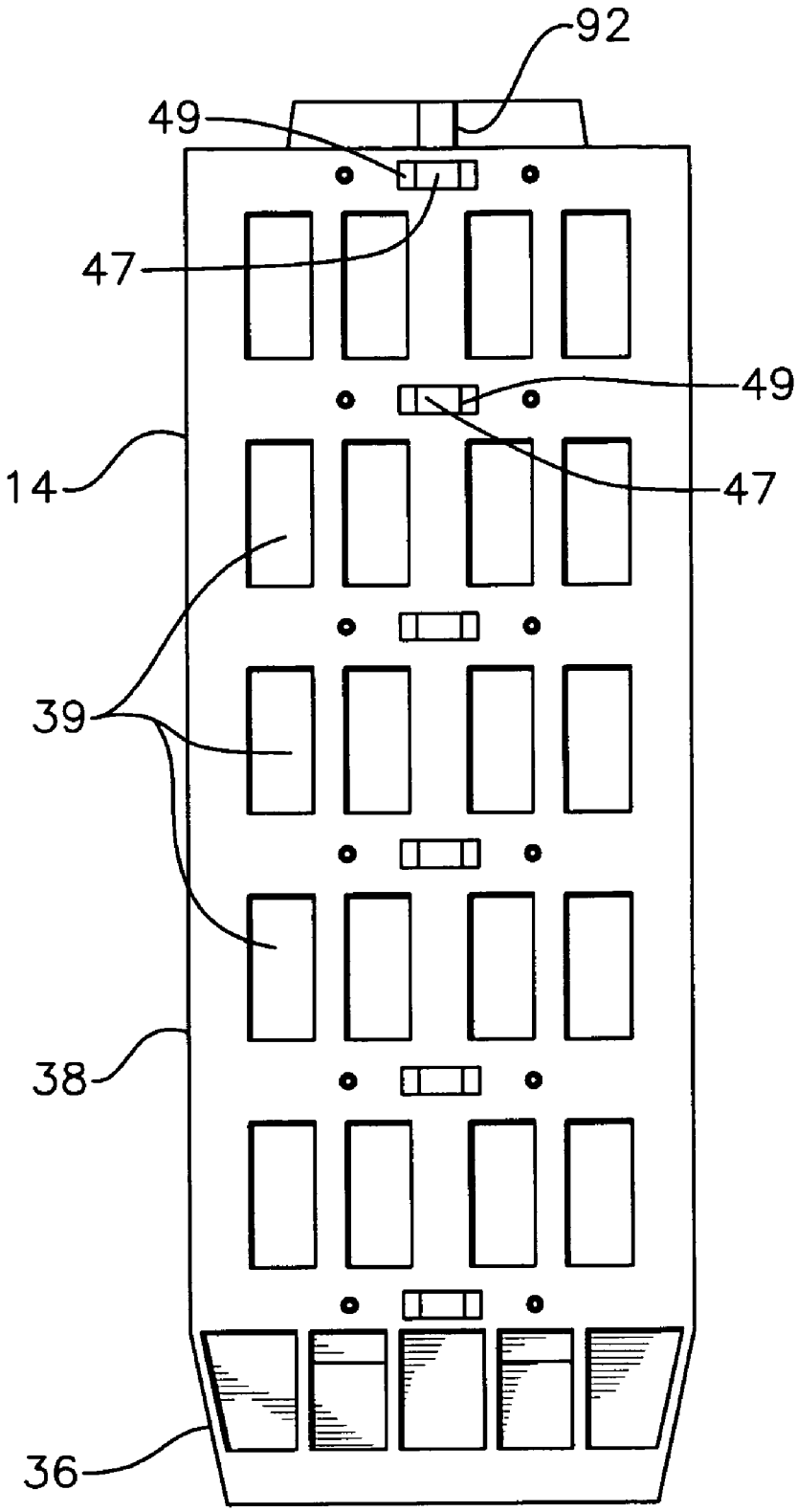
FIG. 3 is an elevational exterior view of a representative support post.
Figure 4:
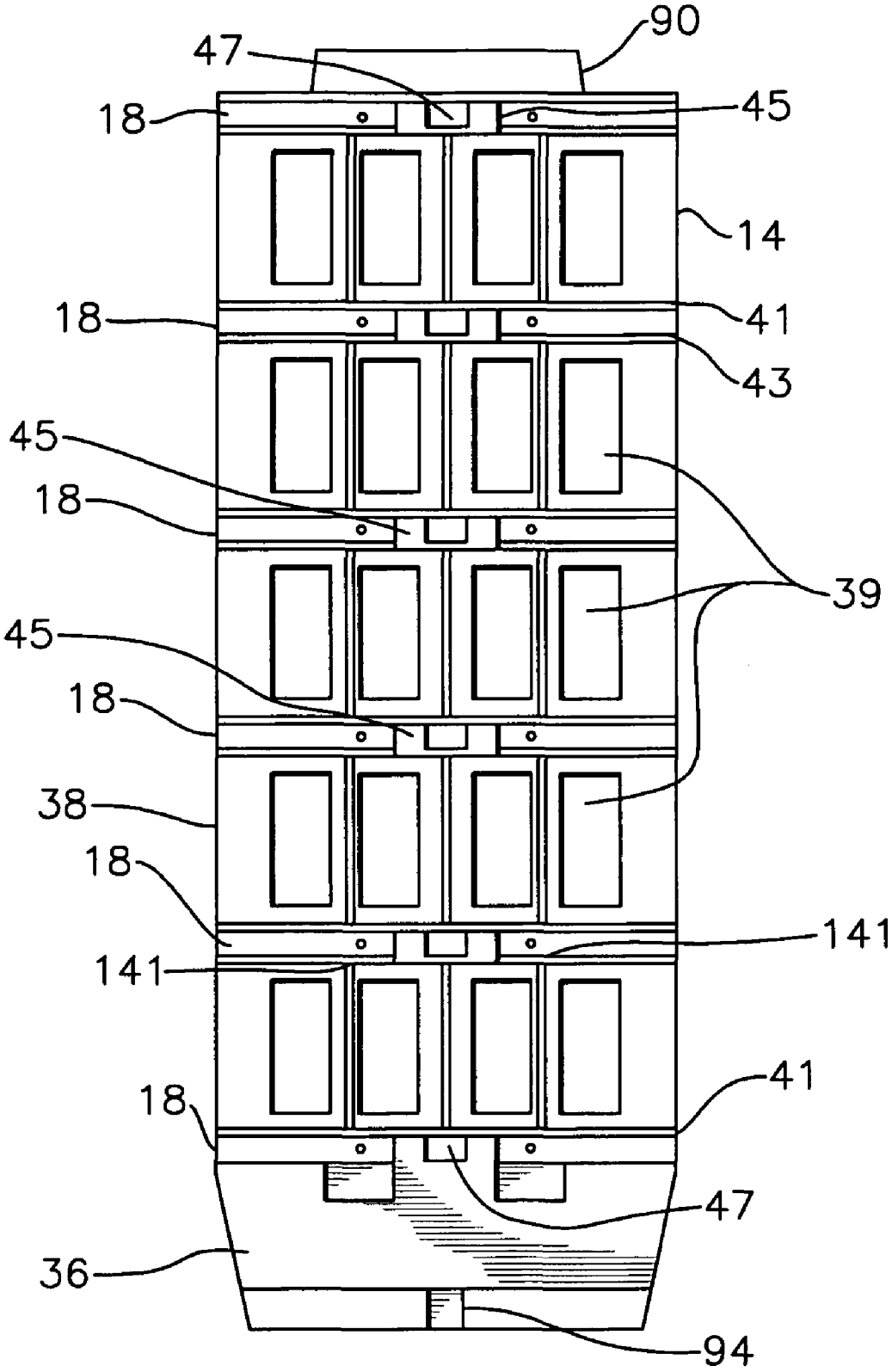
FIG. 4 is an elevational interior view of the support post.
Figure 5:
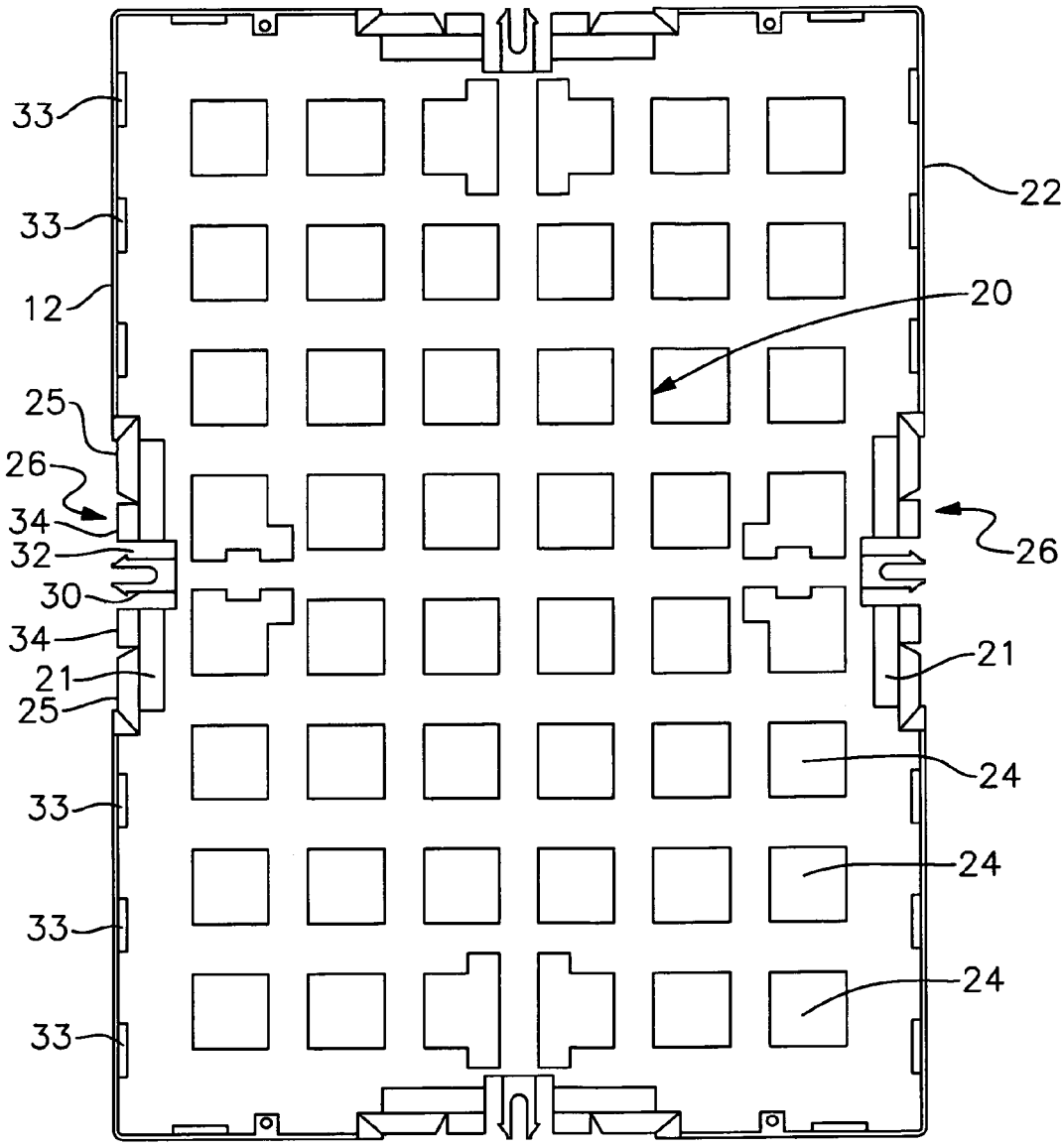
FIG. 5 is a top plan view of a representative shelf employed in the table of this invention.
Figure 6:
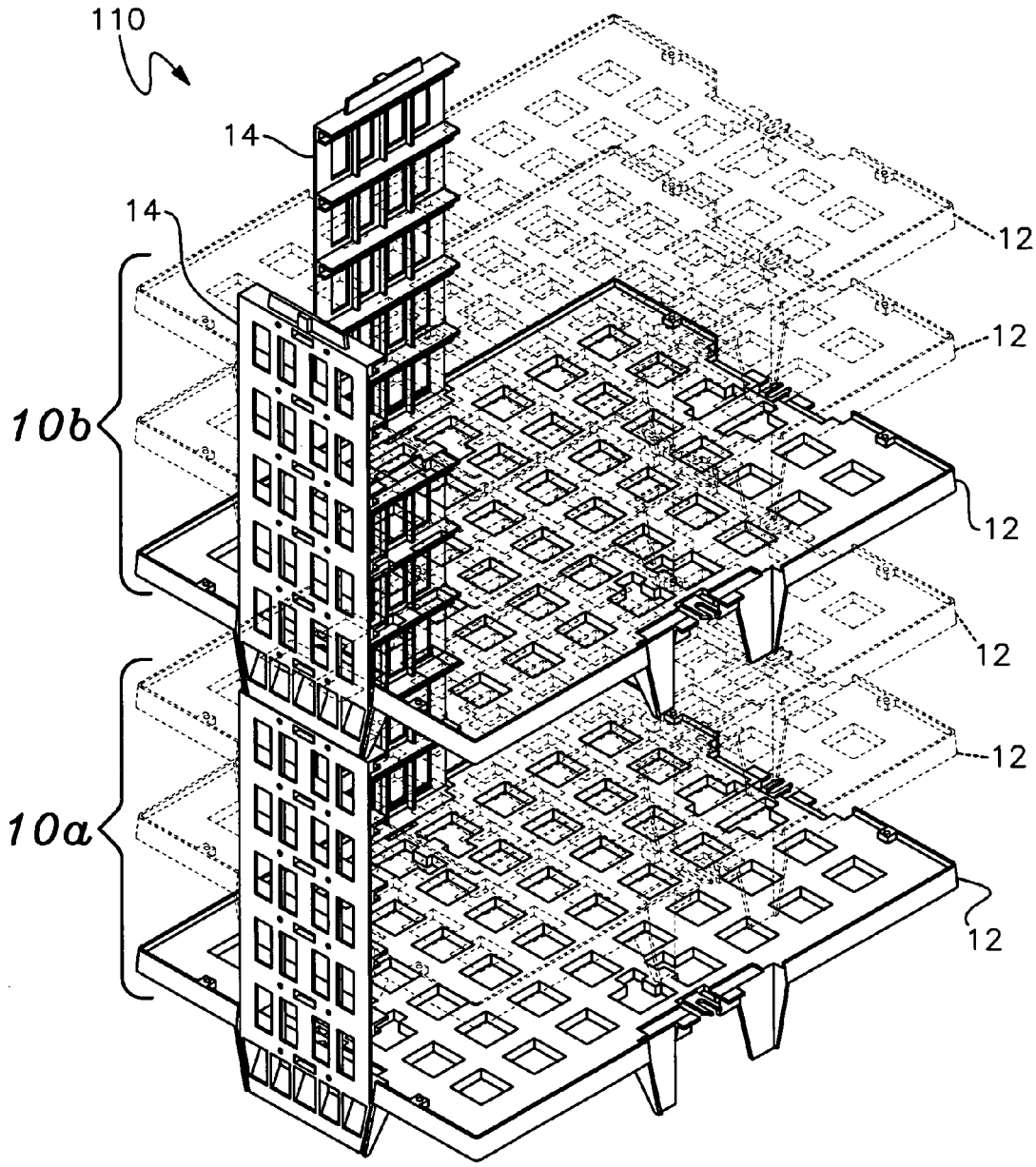
FIG. 6 is a perspective view of a table wherein two three-shelf tables are assembled in a stacked manner to accommodate a total of six shelves; four of the shelves are shown in phantom and two of the support posts are omitted for clarity.

In particular, table 10 features a plurality of rectangular, molded plastic shelves 12 (shown alone in FIG. 5), as well as four molded plastic support posts 14 (shown individually in FIGS. 3 and 4). Each support post is interengaged at the midsection of a respective side of each rectangular shelf 12. In FIG. 2, a single support post and two interengaged shelves are shown. The other support posts and shelves are omitted from FIG. 2 for clarity. However, it should be understood that a support post 14 is installed at each midsection of each shelf 12 in a manner generally similar to that shown in U.S. Pat. No. '434, the description of which is incorporated herein by reference. In addition, each support post is constructed to be capable of interengaging and supporting multiple upper shelves 12, which are retainably mounted to the support posts of table 110 at selectively spaced apart heights. It should be understood that each shelf and support post is constructed and assembled in a manner similar to that described herein. The shelves and support posts are assembled such that the shelves are held generally parallel to one another. In the version shown herein, as many as six shelves 12 may be installed (in each set of four support posts) although various lesser numbers of shelves may be employed for accommodating greater product heights on the table. Such versatility is achieved because each support post 14 includes six horizontal channels 18 for respectively engaging and retaining a corresponding plastic shelf. In some cases, however, a lesser number of shelves (e.g. three shelves in FIGS. 1 and 1A) may be employed and one or more of the channels 18 of each post may be left open and not utilized to support a shelf. In still other versions, additional shelves may be provided by stacking multiple tables vertically as shown in the version of FIG. 6, which is described below. The preferred means for interengaging each horizontal channel with a corresponding shelf 12 is likewise described more fully below.

Each support post preferably comprises a molded plastic construction as set forth in U.S. Pat. No. '434. A critical inventive aspect of this invention relates to the use of a one-piece plastic shelf in transport tables of this type. As shown in FIGS. 1 and 5, representative shelf 12 utilizes a molded plastic construction. Each shelf 12 (and likewise each post 14) may be composed of various different types of plastic. It is particularly preferred to use recycled structural foam, which is strong, durable and relatively inexpensive. The use of such material also significantly simplifies and improves the efficiency of the molding operation. Injection molding and alternative manufacturing techniques may be utilized to manufacture both the one-piece shelves and the vertical support posts.

As best shown in FIGS. 2 and 5, shelf 12 has an interior framework 20 and a peripheral lip 22 that extends about framework 20. Framework 20 features a rectangular grid configuration wherein a series of holes or openings 24 are formed vertically therethrough in regular or uniform rows and columns. Each vertical opening has a generally rectangular configuration.

Peripheral lip 22 extends longitudinally along each of the four side edges of framework 20. The midsection of each side includes a gap 26 that is formed in lip 22. Framework 20 includes an elongate recess 21 that is formed in the upper surface of the framework proximate the edge of the shelf and within each gap 26 of lip 22. Recess 21, which is best depicted in FIGS. 2 and 5, essentially comprises a reduced thickness portion of the framework. A pair of legs 23 depend unitarily from each recessed portion of the framework. Each leg includes an outwardly facing plate 25 that depends from the floor of recess 21 and a tapered piece 27 attached perpendicularly to plate 25 and having a tapered configuration that narrows from an upper end attached to the lip to a lower end at the bottom of the legs. These legs, which are formed at the midsection of each side of shelf 12, support the shelf on an underlying surface when the table 10 is disassembled. As a result, product can be supported by the individual disassembled shelves for display at a store or other retail location. One shelf effectively creates a four way entry pallet, Within each gap 26, the shelf includes additional structure that serves to releasably engage the shelf with a respective support post 14. In particular, as shown in FIGS. 2 and 5, a first connector element comprising a quick-connect spring clip 30 extends unitarily outwardly from the side of framework 20 through a generally rectangular notch 32 formed in the framework and particularly through the recess 21 thereof. Clip 30 is releasably engagable with a respective support post in a manner described below. A pair of support tabs 34 are also unitarily connected to the framework 20 and extend outwardly from recess 21 on respective sides of clip 30. These tabs are likewise interengagable with the support post as described below. As best shown in FIG. 2, tabs 34 have a thickness that is less than that of either framework 20 or the peripheral lip 22 that extends about the framework. All of the foregoing structure is formed unitarily with the other components of the shelf during the molding process or other manufacturing process. The structure of the shelf formed within each gap 26 allows a respective support post to be received by the gap and retainably engage the shelf at the midsection of each side of the shelf. Such interconnection and assembly is again described more fully below.

Lip 22 of shelf 12 is molded such that it projects vertically about ½" above the upper surface 13 of framework 20. The lip may include a total top to bottom width of approximately 1½". In such cases, the framework has a thickness of approximately 1". These dimensions may be varied within the scope of this invention. The periphery of shelf 12 includes a series of spaced apart voids 33 vertically through, which reduce the material required by and resultant weight of the shelf without significantly reducing structural integrity.

Each post 14 includes a supportive lower end section 36, FIGS. 2-4, for engaging a floor or other underlying surface upon which the table is supported. The lower section 36 may alternatively engage the upper end of an underlying lower post 14 when multiple tables are stacked as depicted in FIG. 6 and described below. An intermediate, shelf supporting section 38 is attached unitarily to lower section 36 and extends upwardly therefrom. Intermediate section 38 includes recess portions 39, as well as horizontal channels 18. Recess portions 34 reduce the material required and permit uniform cooling when the plastic posts are molded. Such benefits are also achieved by forming the vertical openings 24 through each shelf 12. An elongate flange 90 is formed unitarily at the top end of each post 14. The flange includes a molded guide 92 that protrudes from an outer surface of the flange for interengaging a conforming slot 94 formed in the lower section 36 of the post when tables are stacked as described below.

As best shown in FIG. 4, each of the horizontal channels 18 formed on the inside surface of post 14 includes a relatively wide upper rib 41 (see FIG. 2) and a relatively narrow lower rib 43, which may have segments 141 that feature even narrower widths proximate the central vertical axis of each post. In addition, each channel 18 and, particularly, the lower rib 43 of each such channel, is intersected by a respective retention block 45, FIG. 4, having a slot 47 formed therethrough. As best shown in FIG. 3, a latching receptacle 49 is formed in the outer surface of the post adjacent to and in communication with each transverse locking slot 47. Slot 47 has a width that is narrower than the normal unbiased width of a corresponding spring locking clip 30, whereas latching receptacle 49 has a width that is greater than the unbiased width of clip 30. As a result, this structure allows a corresponding spring clip to be lockably received through the slot 47 so that a shelf may be releasably locked at each side midsection of the shelf to a respective support post and, more particularly, at a height corresponding to a selected retention block 45 and locking slot 47. Once again, the precise assembly of these complementary connector components is described more fully below.

Each retention member 45 is generally formed within a respective channel 18 such that the retention members are positioned centrally and aligned generally vertically on post 14. Each retention block 45 has a shape that generally conforms to the configuration of a corresponding rectangular notch 32 in shelf 12. This assists the secure interengagement between the posts and shelves as described below.

The outer surface 50 of each support post 14 is perfectly smooth as shown in FIG. 3. This allows the display table to be set-up and installed in either a transport vehicle or commercial site quickly and conveniently without catching or snagging on adjoining items. By the same token, the support post can be collapsed and stacked without undo interference, snagging or other problems.

Table 10 is assembled in the manner generally shown in FIGS. 1 and 2. Specifically, each of the four support posts 14 is interengaged with a lowermost shelf 12 as follows. As illustrated in FIG. 2, each support post is received by a respective midsection gap 26 in peripheral lip 22 of shelf 12. The upper rib of the lowermost channel 18 of post 14 snugly interengages the framework recess 21 and the corresponding side of the shelf. Insertion tabs 34 of shelf 12 are likewise engaged with lowermost channel 18 on respective sides of retention block 45. Block 45 is itself conformably and snugly received within corresponding notch 32. Spring clip 30 is inserted through the lowermost locking slot 47. Because the width of slot 47 is smaller than the width of the unbiased spring clip, the prongs of clip 30 are squeezed together as they past through slot 47. After emerging from the slot, the prongs open within latching receptacle 49 and thereby releasably lock the clip within the receptacle. As a result, the support post is securely interengaged with and locked into the midsection of a respective side of the lowermost shelf 12. Each of the four support posts is interengaged with a respective side of the lowermost shelf in an analogous manner. One or more additional upper shelves (two upper shelves in FIG. 1) are then interengaged with the four midsection support posts by interengaging each shelf in the same manner within each of the posts at a desired height. Shelves may be engaged with each of the horizontal channels 18. Alternatively, one or more channels may be skipped to provide a selected spacing between the shelves. When all of the shelves are installed in this manner, the completed table features an overall appearance as shown in FIG. 1. The depending legs 23 of lowermost shelf 12 nest with the lower sections 36 of respective posts 14. The legs of the upper shelves engage the inside surfaces of the respective posts.

It should be understood that table 10 may be alternatively assembled by first attaching a selected post to all of the shelves and then sequentially attaching the remaining posts to the shelves. Either manner of assembly utilizes the same interengagement between the posts and shelves.

The precise, positive and consistent interengagement and interconnection formed between the framework 20 and each post 14 provides for a greatly improved structural integrity and strength. The interengagement between respective spring clips 30 and locking slots 47/latching receptacles 49 securely locks the shelves and posts together and effectively resists accidental collapse of the table. The snug and conforming interengagement between retention blocks 45 of posts 14 and respective notches 32 in the framework 20 of shelves 12 further improves the tight and secure structural integrity of table 10. Product is thereby held securely and protectively by the table during transport, storage and display.

Vertical openings 24 feature an additional particular advantage when the table is used to support potted flowers and plants. In particular, individual containers may be inserted through respective openings 24 and thereby held securely within framework 20. This eliminates the need to use large flats and trays for holding the plants or flowers. Potential cost savings are therefore realized.

FIG. 6 depicts an alternative transport and display table 110 that includes six shelves 12. This version of the invention is constructed by vertically stacking a pair of tables 10 as previously described. In particular, each post 12 in lower table 10*a* is engaged by the lower end of a respective post in upper table 10*b*. The lower slot 94 (FIG. 4) in each post of the upper table is slidably interengaged with a conforming guide 92 (FIG. 3) carried by the flange 90 of a respective underlying post in table 10*a*. This securely interengages the lower and upper tables 10*a* and 10*b* in the manner shown in FIG. 6 such that a table comprising four extended support posts and six supported shelves is provided. Additional tables may be stacked upon table 110 in an analogous manner to provide still more shelves.

After displayed product has been completely sold or otherwise removed from the table and/or if the table is to be reshipped for reuse, disassembly and return are performed quickly, conveniently and cost effectively. In particular, support posts 14 are quickly and easily disengaged from respective midsections of the rectangular shelves 12. It is not necessary to remove brackets, nails, screws, etc. The quick-connect spring clips 30 are easily released from their respective locking slots 47 by pressing the prongs of each clip inwardly. The snug fit between channels 18 and framework recesses 21, as well as the snug fit between the retention blocks 45 and notches 32 allows the posts and shelves to be conveniently detached from one another by using only modest force.

Figure 7:
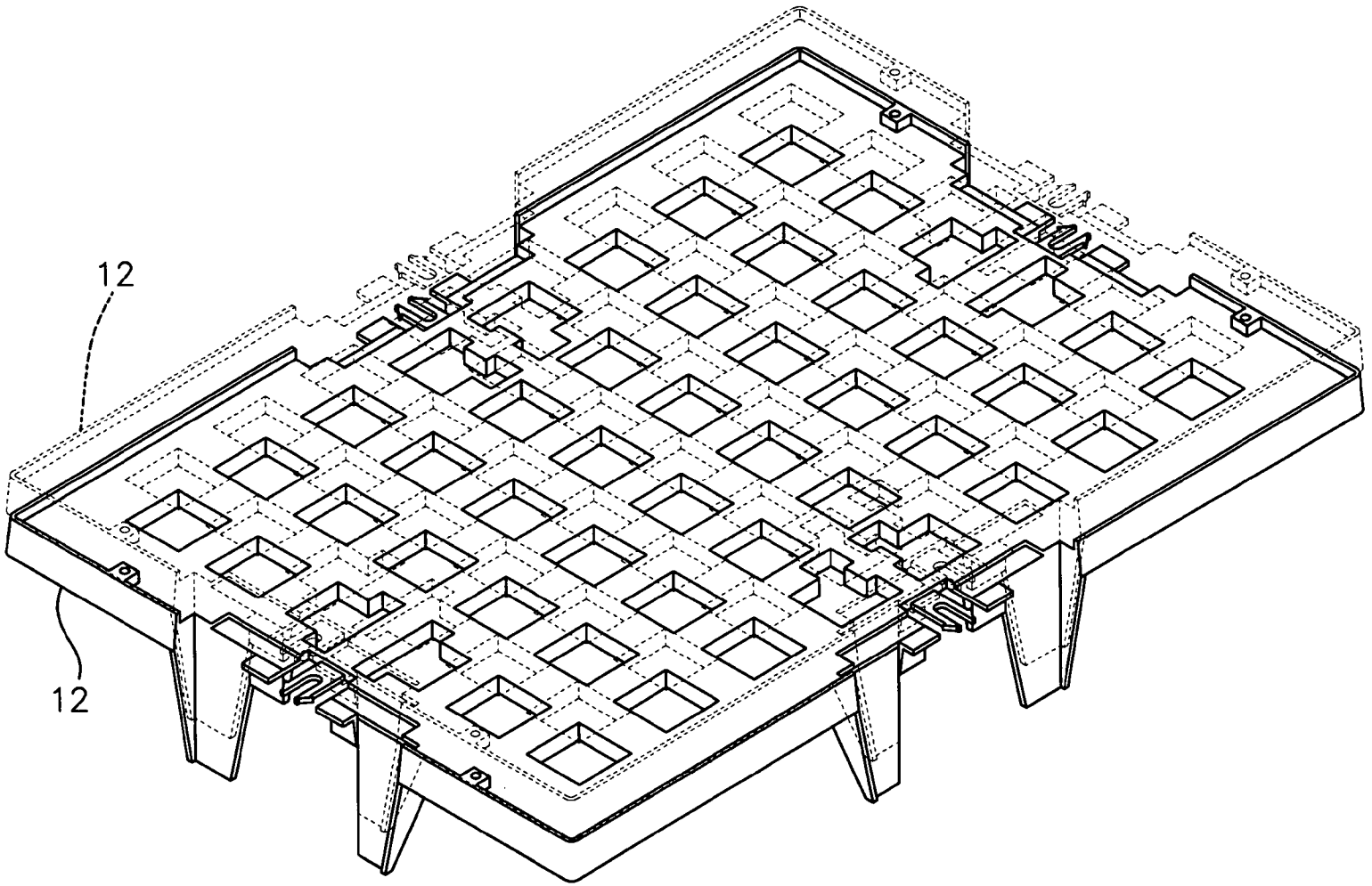
FIG. 7 is a perspective view of a pair of shelves (the upper shelf in phantom) stacked directly upon one another for transportation and storage.
Figure 8:
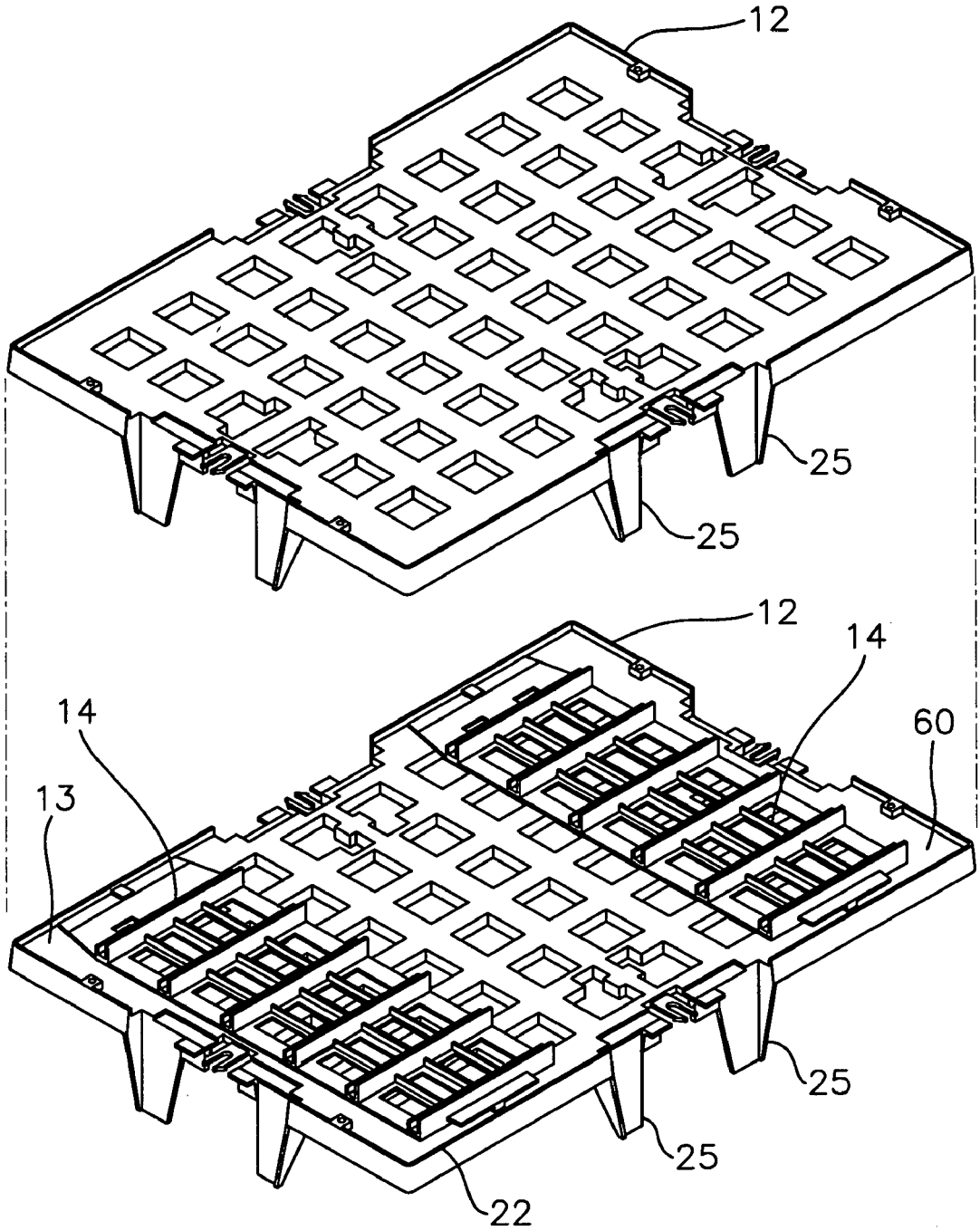
FIG. 8 is a perspective, exploded view of a pair of shelves stacked upon each other and with two collapsed support posts stored upon the upper surface of the lower shelf.

After the posts are disassembled, they may then be conveniently collapsed and compactly stored, as shown in FIG. 8, within an upper receptacle 60 formed in the upper surface of shelf 12. As previously indicated, lip 22 projects approximately ½" above upper surface 13 of framework 20 such that lip 22 forms the receptacle 60 for accommodating the four collapsed posts 14 (two of which are shown in FIG. 8). The shelf has a length and width that allow it to accommodate the four support posts 14 within the receptacle 60 formed within the shelf. Each post 14 is simply placed with its interiorly facing surface down and directly against the upper surface 13 of framework 20. Additional shelves 12 may then be stacked upon the bottom shelf and disassembled posts accommodated thereon. A pair of stacked shelves without collapsed posts between the shelves are shown in FIG. 7. In either of the stacked shelf conditions (FIG. 7 or 8), the legs 25 of the upper shelf nest into the legs of the immediately underlying shelf. This allows table 10 to be collapsed into an extremely compact condition that makes the product much more convenient to store and/or ship. Such convenience greatly adds to the cost savings provided by the product and causes the product to be much more appealing for use by retail establishments that sell plants, flowers and other types of products typically accommodated by the table. Virtually any number of shelves may be stacked in the manner shown in FIGS. 7 and/or 8.

Still additional advantages are achieved by using the plastic shelves and table assembly of this invention. The prior art plastic posts feature a lowermost channel that is wider than the upper shelf supporting channels in order to accommodate a second piece of plywood as a scuffboard. In contrast, the lowermost post channel 18 of table 10 has a width comparable to the remaining channels 18. Table 10 of the present invention therefore does not require the use of a second piece of plywood in the lowermost position to act as a scuffboard. Instead, the strength and durability of molded shelf 12 permits a single shelf to be used as the base shelf. The lowermost channel is therefore molded to match the remaining channels, which facilitates the molding and manufacturing process and allows the use of a more uniformly configured support post.

The one-piece molded plastic shelf of this invention is a significant improvement over plywood shelves used in conventional transport and display tables. Using a molded plastic shelf eliminates the problem of miscut, imprecise and wasted plywood. Instead, applicant's shelves are manufactured uniformly and fit precisely with the support posts virtually all of the time. It is therefore no longer necessary to construct a new shelf because a plywood shelf has been inaccurately measured or miscut. Considerable time, labor and expense are therefore saved. By the same token, applicant's shelves are stronger and resist wear, deterioration and aging much more effectively than conventional plywood shelves. Applicant's shelves effectively avoid sagging under product weight.

The present invention provides for a collapsible transport, storage and display table that can be used much more efficiently and cost effectively than previous tables. Because the use of plywood shelves is avoided, there is now a much greater reason to use the center or midlength support post disclosed in U.S. Pat. No. '434. As a result, the improvements of improved supportive strength and four way forklift accessibility are more conveniently available and likely to be achieved.

The table of this invention is the superior to conventional steel racks. Table 10 is less expensive and collapses much more compactly. It also provides stronger support and resists rust and deterioration far more effectively than steel racks.

From the foregoing it may be seen that the apparatus of this invention provides for a collapsible transport, storage and display table that is especially suited for accommodating small, crushable or sensitive items such as containers of flowers, plants and similar items. While this detailed description has set forth particularly preferred embodiments of the apparatus of this invention, numerous modifications and variations of the structure of this invention, all within the scope of the invention, will readily occur to those skilled in the art. Accordingly, it is understood that this description is illustrative only of the principles of the invention and is not limitative thereof.

Although specific features of the invention are shown in some of the drawings and not others, this is for convenience only, as each feature may be combined with any and all of the other features in accordance with this invention.

Other embodiments will occur to those skilled in the art and are within the following claims:

What is claimed is:

1. A collapsible table for transporting and displaying potted horticultural products, said table comprising:

a plurality of rectangular shelves, each said shelf having a unitary, molded plastic construction and including an interior framework with a series of openings formed vertically therethrough, said shelf further including an exterior lip extending peripherally about said framework, said lip including a gap at a midsection of each side of said shelf, each said shelf having four pairs of legs, each said pair of legs depending downwardly from said shelf within a respective said gap formed in said peripheral lip of said shelf;

four plastic support posts, each said post retainably and releasably interengaging each said shelf through a respective said gap of said shelf, each said support post including a supportive lower portion and an upper portion extending vertically upwardly from said lower portion and carrying at least one inwardly facing horizontal channel, each said channel for releasably interengaging and retaining said framework of a respective said shelf through a respective said gap.

2. The table of claim 1 in which each said gap of said shelf removably receives said horizontal channel of a respective said support post such that said received channel supportively interengages a recessed position of said framework of said shelf, whereby each said shelf is securely interengaged with and supported by each of said support posts.

3. The table of claim 1 in which each said shelf includes a framework having a rectangular grid pattern with multiple rows and columns of said openings formed vertically therethrough.

4. The table of claim 1 in which each shelf carries a set of first connector components, each first connector component disposed within a respective said gap of said shelf, and said support posts carry a complementary set of second connector components, each second connector component of said complementary set carried by a respective said support post and said second connector components of said complementary set being located at substantially equivalent heights along said respective support posts, each second connector component of said complementary set for releasably and retainably interengaging one of said first connector components of a respective said shelf.

5. The table of claim 4 in which said first connector components include spring clips attached to and extending from respective sides of said framework and said second connector components include locking slots for lockably and releasably receiving respective said spring clips to releasably secure said shelves to said support posts.

6. The table of claim 5 in which each said support post includes a series of locking slots arranged in a central, vertically spaced apart pattern in said support post.

7. The table of claim 5 in which each said locking slot is formed through a respective said horizontal channel.

8. The table of claim 7 further including a retention block carried by each said support post within at least one said channel carried thereby, at least one of said locking slots being formed through a respective said retention block.

9. The table of claim 5 in which said framework includes a notch within each said gap in said peripheral lip, a respective spring clip being attached unitarily to said framework and extending outwardly through said notch.

10. The table of claim 7 in which said framework includes a notch within each said gap in said peripheral lip, a respective spring clip being attached unitarily to said framework and extending outwardly through said notch.

11. The table of claim 10 in which each notch receives a respective retention block such that said spring clip extending through said notch is receivable by said locking slot formed in said retention block to releasably fasten a respective said supporting post to one side of a respective said shelf.

12. The table of claim 11 in which said framework of each said shelf includes a tab element having a reduced thickness adjacent each said gap for engaging a horizontal channel of said support post on respective sides of said retention block.

13. The table of claim 1 in which said legs slant outwardly from said shelf for interengaging an inwardly facing surface of a respective support post, said legs for supporting a respective said shelf upon an underlying surface when said shelf is disengaged from said support post.

14. The table of claim 1 in which said upper portion of said post carries a mounting flange proximate an upper end of said support post for engaging a lower portion of a support post stacked thereon, whereby additional support posts may be stacked upon said four support posts when said four support posts are retainably interengaging at least one said shelf.

15. The table of claim 13 in which each said pair of legs of a respective said shelf nestably interengage said supportive lower portion of a respective said support post when said support posts are retainably interengaged with said respective shelf.

16. The table of claim 1 in which said peripheral lip and said framework of each said shelf defines a receptacle for accommodating said four support posts therein when said support posts are disengaged from said shelf.

17. The table of claim 1 in which said shelves, each releasably and retainably interengagable with said support posts and in which each said shelf includes a plurality of positionally corresponding alignment holes formed vertically through said framework and being aligned when said shelves are interengaged with said support post for receiving respective alignment rods therethrough.

18. The table of claim 17 in which a plurality of said alignment holes are formed proximate said lip of each said shelf and a single alignment hole is formed centrally through each said shelf, said alignment holes being formed in corresponding positions in said respective shelves.

* * * * *